United States Patent [19]

Driesen et al.

[11] Patent Number: 4,939,914

[45] Date of Patent: Jul. 10, 1990

[54] JIG

[75] Inventors: Manfred Driesen; Wolfgang Kurschatke, both of Krefeld; Johannes Kutz, Tonisvorst, all of Fed. Rep. of Germany

[73] Assignee: Eduard Küsters Maschinenfabrik GmbH & Co KG, Krefeld, Fed. Rep. of Germany

[21] Appl. No.: 669,529

[22] Filed: Nov. 8, 1984

[30] Foreign Application Priority Data

Nov. 19, 1983 [DE] Fed. Rep. of Germany ..... 3341915

[51] Int. Cl.[5] ..... D06B 15/02

[52] U.S. Cl. ..... 68/22 R; 68/180

[58] Field of Search ..... 68/22 R, 180

[56] References Cited

U.S. PATENT DOCUMENTS

| | | | |
|---|---|---|---|
| 536,724 | 4/1895 | Hinze | 68/180 |
| 739,580 | 9/1903 | Boral et al. | 68/22 R |
| 741,188 | 10/1903 | Theis | 68/180 X |
| 808,007 | 12/1905 | Cadgene | 68/180 |
| 1,026,226 | 5/1912 | Rossiter | 68/180 |
| 1,131,084 | 3/1915 | Rau et al. | 68/180 |
| 2,136,571 | 11/1938 | Welder | 68/180 X |
| 2,151,363 | 3/1939 | Welder | 68/180 X |
| 2,204,839 | 6/1940 | Welder | 68/180 X |
| 3,036,359 | 5/1962 | Cocker | 68/22 R X |
| 3,037,370 | 6/1962 | Rezzonico | 68/22 R X |
| 3,247,660 | 4/1966 | Reeda et al. | 68/180 X |

FOREIGN PATENT DOCUMENTS

| | | | |
|---|---|---|---|
| 426703 | 6/1967 | Switzerland | 68/180 |

*Primary Examiner*—Frankie L. Stinson

*Attorney, Agent, or Firm*—Kenyon & Kenyon

[57] ABSTRACT

A jig has two winding rolls in two troughs which surround the winding rolls concentrically and contain treatment liquor, and a squeezing device for a web of material passing from the one to the other winding roll arranged between the winding rolls. The squeezing device is arranged high enough that the web of material runs from the squeezing device downward toward both sides. A partition extends upward between the troughs up to the squeezing device.

14 Claims, 1 Drawing Sheet

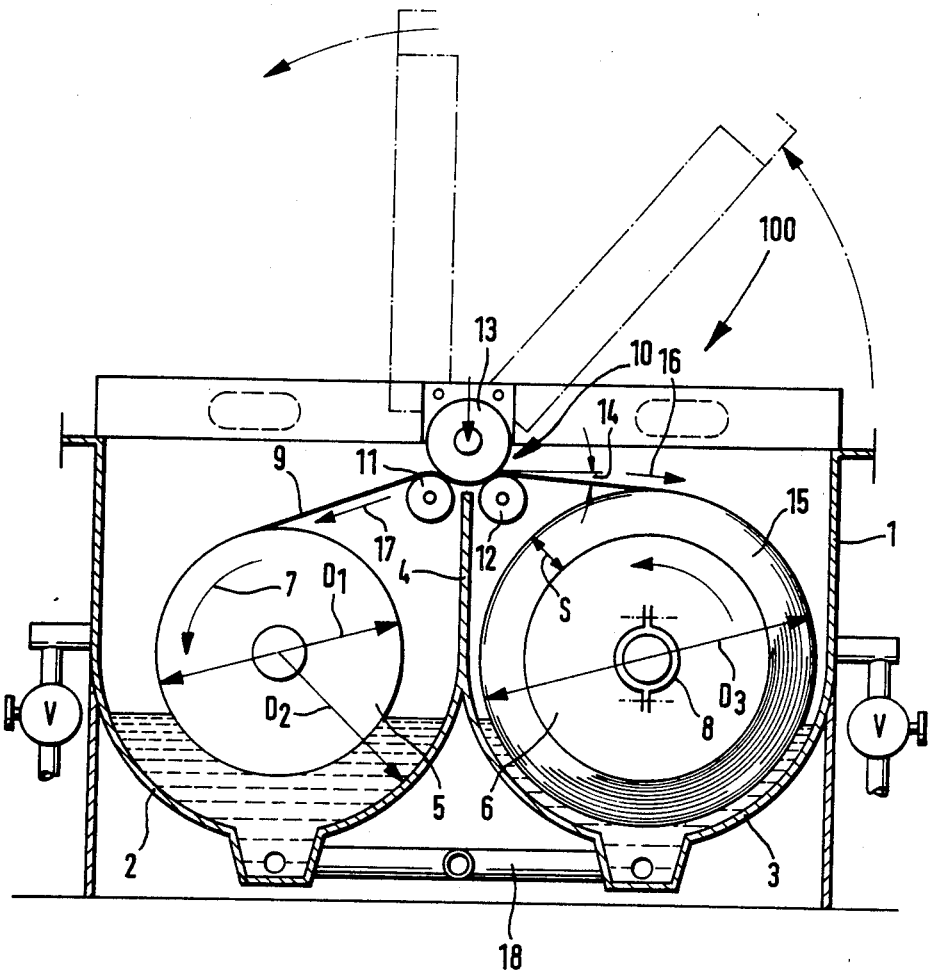
100
13
10
16
14
9
11
15
1
17
12
4
7
D1
S
D2
D3
8
V
V
5
6
2
3
18

JIG

BACKGROUND OF THE INVENTION

This invention relates to apparatus for treating textile webs and the like and more particularly to a jig for carrying out liquid treatments on textile webs of material A jig which includes two substantially identical, mutually parallel winding rolls disposed approximately at the same height, between which a web of material is rewound, a housing which comprises two adjacent troughs which have approximately semicircular cross section in their lower portion, which meet along an approximately equatorial generatrix line, surround the winding rolls concentrically and contain treatment liquor, with lines opening into the lower region of the troughs for feeding the discharging treatment liquor and for interconnecting the troughs and a squeezing device for the web of material as it is transferred from one winding roll to the other, disposed above the zone in which the two troughs meet, the squeezing device formed by two rolls arranged horizontally side-by-side and a roll resting thereon, is described in German patent No. 165,550. In this known design, however, the squeezing device is arranged in the middle between the two windings right above the plane extending through the roll axis, so that, with all winding diameters, the web of material runs away from the winding downward toward the squeezing device. As a result, treating liquor runs along the web downward and forms a bead of liquor at the lower rolls of the squeezing device, at least on that side of the web of material entering the device Liquid flows off from the bead of liquor in a direction transverse to the web. This cross-flow brings about a non-uniformity of the treatment which, in the case of dyeing operations, leads to a non-uniform dyeing result and therefore to rejections.

In the known design, there is also, underneath the cooperating rolls of the squeezing device, a gap between the two troughs, through which, particularly at higher operating speeds, liquid can splash from one trough into the other.

It is an object of the present invention to develop a jig of this general type in such a manner that the treatment result can be maintained uniform and separation of the baths between the troughs is improved.

SUMMARY OF THE INVENTION

In accordance with the present invention, this problem is solved through the use of a vertical partition extending up from the zone in which two troughs meet, approximately to the apex of the windings, with the squeezing device arranged immediately above the upper edge of the partition in such a manner that the passing web of material runs from the squeezing device downward to both sides.

As a result of this arrangement, the web of material drops from the squeezing device on both sides toward the windings, so that no bead of liquid can build up at the squeezing device due to liquid running down the web and no cross-flow which leads to non-uniformities of treatment over the width of the web can develop. By extending the wall upward, a clean separation of the treatment liquors contained in the two troughs is possible under all operating conditions.

The angle, at which the web of material, as seen from the squeezing device, drops toward the two windings, of course, changes during the winding with the diameter of the winding. It is advisable to design the arrangement so that even for the maximum winding diameter, a minimum angle of 5° prevails.

An important embodiment of the present invention is one in which the maximum thickness of the winding is at most one-quarter of the diameter of the winding rolls.

The diameter of the winding roll is, therefore, relatively large as compared to the diameter of a roll winding located thereon. This measure has the purpose of keeping the thickness of a winding as small as possible with a given normal capacity of the jig, for instance, a footage of about 1,000 m of a textile fabric web, so that good penetration of the winding with treatment liquor is possible. At the same time, good guidance is obtained because of the large diameters of the winding rolls; this guidance does not change substantially during the winding because of the reduced diameter differences.

Winding rolls with relatively large diameters are known per se from German patent No. 528,983. However, there the large diameter is used to provide sufficient buoyancy for the winding rolls which, floating in the treatment liquor, are pushed against a matching roll containing the winding under the action of the buoyancy from below.

A further important feature of the present invention is in the troughs having a diameter which exceeds the winding diameter by at most 100 mm. This means that the troughs enclose the winding relatively closely at the maximum diameter. This results in a reduction of the required quantity of treatment liquor, which may be of great importance particularly in dyeing. The filling level in the troughs is chosen so that the winding rolls in the empty condition already have their lower part immersed somewhat in the

BRIEF DESCRIPTION OF THE DRAWINGS

The sole drawing FIGURE shows a schematic cross-sectional view of a jig constructed according to the principles of the present invention.

DETAILED DESCRIPTION

The jig 100 of the present invention includes a housing 1 in which troughs 2 and 3 of approximately semicircular cross section are formed closely adjacent to each other. Troughs 2 and 3 come together along a generatrix at about the height of the equator, within the walls of the troughs 2 and 3 and merge into a common partition 4. Mutually parallel windings rolls 5 and 6, concentric with the troughs, are supported in the troughs. The left winding roll 5 is driven in the direction of the arrow 7 in the illustrated embodiment. The rewinding roll 6 to the right is held back by a brake. A control, not shown, is provided which controls the drive and the brake in such a manner that a uniform web velocity and a uniform web tension are obtained.

In the transition from the winding roll 6 to the winding roll 5, the web of material 9 passes through a squeezing device 10 which consists of two lower rolls 11 and 12 disposed on opposite sides of the partition 4, and a roll 13 which is arranged above. Roll 13 can be lifted off and can be adjusted as to its line pressure. It forms a rolling gap with each of the lower rolls 11 and 12. The squeezing device 10 is arranged in the upper portion of the housing 1 in such a manner that the web of material, as seen from the squeezing device 10, extends downward toward both winding rolls 5 and 6, i.e., forms an angle 14 which, even for a full winding 15 on the respective side, is still at least 5°.

The liquid which is taken along by the winding 15 on the winding roll 6 from the trough 3 runs, to the extent that it is not been absorbed by the web, against the direction of travel of the web shown in the drawing, in the direction of the arrow 16, largely back into the trough 3 so that no substantial liquor bead is formed at the rolling gap between the rolls 12 and 13, which could give rise to a cross flow. The liquor taken up by the web of material 9 on the winding roll 5 is wrapped into the corner 17, so that there, a particularly intensive impregnation of the web of material 9 with the treatment liquor is obtained.

The treatment liquor which is squeezed out on the side of the winding running down, i.e., on the side of the winding roll 6 in the drawing, runs back into the corresponding trough 3 and does not get into the trough 2, for instance. This is due to the presence of two rolling gaps which are provided on both sides of the partition 4. Also, a bulkhead which prevents splashing of treatment liquor from one trough to the other is provided in that the partition 4 extends up to between the lower rolls 11 and 12, and closely under the upper roll 13.

The troughs 2 and 3 have separate feed and discharge lines and can furthermore be tied together by a line 18 connected in the lower region, communicating with each other. Thereby, the most varied charges of the troughs and the most different operating cycles can be brought about. If the treatment liquor is, for instance, a dyeing liquor and if the troughs 2 and 3 are connected to each other so as to be in communication, the winding which increases on the winding roll 5 will by-and-by displace the dyeing liquor contained in the trough 2 and push it over into the trough 3, so that an equalization of the concentration with the dyeing liquor still present there takes place.

The filling level in the troughs 2 and 3 is, of course, chosen so that the treatment is uniform over the entire length of the web 9, i.e., the web 9 is either immersed in the liquid over its entire length or is wound dry over its entire length This depends on the treatment desired in the individual case.

The diameters D1 of the winding rolls 5 and 6 are 600 mm in the illustrated embodiment; the diameters D2 of the lower semicircular parts of the troughs 2 and 3 are 900 mm and the maximum winding diameters D3 are 850 mm. Therefore, the layer thickness S of the winding 15 is relatively small as compared to the diameter D1 of the winding roll 6, i.e., the diameter D1 is larger than normal. Thereby, the winding 15 is well saturated by the treatment liquor in the trough 4, and the running conditions of the web do not change much between the start and the end of the winding, i.e., the speed differences and the radius differences of the windings are smaller This in turn facilitates the control and an improved run of the web results The layer thickness S in the illustrated embodiment is 125 mm and generally should amount to not more than one-quarter of the diameter D1.

The maximum winding diameter D3 largely approximates the diameter D2 of the troughs 2 and 3 in their lower part and, in the illustrated embodiment, is only 50 mm smaller However, the difference should be not more than 100 mm so that as little treatment liquid as possible remains in the trough when the winding is complete In the illustrated embodiment, the left winding roll 5 is shown driven, while the brake 8 is shown at the right winding roll 6. This is only a schematic presentation. It is understood that in rewinding against the travel direction shown in the drawing, the right winding roll 6 is driven and the left winding roll 5 is braked. Actually, both winding rolls 5 and 6 have a brake and one drive is switched over from one winding roll to the other.

What is claimed is:

1. A jig for carrying out liquid treatments on a textile web of material, comprising:

two substantially identical, mutually parallel winding rolls disposed approximately at the same height, between which the web of material is rewound;

a housing which comprises two adjacent troughs which have approximately semicircular cross-sections in their lower portions, meet along an approximately equatorial generatrix line, surround the winding rolls concentrically and are adapted to contain treatment liquor;

lines opening into lower regions of the troughs for feeding and discharging treatment liquor and for interconnecting the troughs;

a vertical partition extending up from a zone in which two troughs meet, approximately to an apex of a winding roll containing a full winding; and a squeezing device for the web of material as it is transferred from one winding roll to the other, above the zone in which the two troughs meet, formed by two first rolls arranged horizontally side-by-side and a second roll resting thereon thereby defining two axially spaced rolling gaps, arranged immediately above the upper edge of the partition in such a manner that the passing web of material runs from the squeezing device downward toward the windings on both sides, the partition having an upper end disposed between the first rolls and an upper edge juxtaposed to a lowermost extent of the second roll, one of the first rolls being disposed above one of the troughs and the other of the first rolls being disposed above the other of the troughs whereby treatment liquor squeezed out of the web at the rolling gap formed above said one trough is prevented from passing into said other trough by the partition.

2. A jig according to claim 1, wherein the angle between a horizontal plane and the web of material running to a respective winding is at least 5° when the winding present there is full.

3. A jig according to one of the claim 2, wherein the diameter of the winding rolls is 580 to 650 mm and the diameter of the troughs if 850 to 950 mm.

4. A jig according to claim 2, wherein the layer thickness of the winding is at most one-quarter of the diameter of the winding rolls.

5. A jig according to claim 4, wherein the troughs have a diameter which exceeds the winding diameter by at most 100 mm.

6. A jig according to one of the claim 4, wherein the diameter of the winding rolls is 580 to 650 mm and the diameter of the troughs is 850 to 950 mm.

7. A jig according to claim 2, wherein the troughs have a diameter which exceeds the winding diameter by at most 100 mm.

8. A jig according to one of the claim 7, wherein the diameter of the winding rolls is 580 to 650 mm and the diameter of the troughs is 850 to 950 mm.

9. A jig according to claim 1, wherein the layer thickness of the winding is at most one-quarter of the diameter of the winding rolls.

10. A jig according to one of the claim 9, wherein the diameter of the winding rolls is 580 to 650 mm and the diameter of the troughs if 850 to 950 mm.

11. A jig according to claim 9, wherein the troughs have a diameter which exceeds the winding diameter by at most 100 mm.

12. A jig according to claim 1, wherein the troughs have a diameter which exceeds the winding diameter by at most 100 mm.

13. A jig according to one of the claim 12, wherein the diameter of the winding rolls is 580 to 650 mm and the diameter of the troughs is 850 to 950 mm.

14. A jig according to one of the claim 1, wherein the diameter of the winding rolls is 580 to 650 mm and the diameter of the troughs is 850 to 950 mm.

* * * * *